US005730104A

United States Patent [19]

Hafner

[11] Patent Number: 5,730,104

[45] Date of Patent: Mar. 24, 1998

[54] INJECTION RATE SHAPING DEVICE FOR A FILL METERED HYDRAULICALLY-ACTUATED FUEL INJECTION SYSTEM

[75] Inventor: Gregory G. Hafner, Normal, Ill.

[73] Assignee: Caterpillar Inc., Peoria, Ill.

[21] Appl. No.: 801,378

[22] Filed: Feb. 19, 1997

[51] Int. Cl.[6] ..... F02M 37/04

[52] U.S. Cl. ..... 123/446; 123/300; 123/501

[58] Field of Search ..... 123/446, 456, 123/500, 501, 299, 300

[56] References Cited

U.S. PATENT DOCUMENTS

| | | | |
|---|---|---|---|
| 3,913,546 | 10/1975 | Clouse | 123/501 |
| 3,973,540 | 8/1976 | List | 123/501 |
| 4,411,238 | 10/1983 | Ecomaro | 123/501 |
| 4,625,700 | 12/1986 | Elsbett | 123/501 |
| 4,878,471 | 11/1989 | Fuchs | 123/446 |
| 4,881,506 | 11/1989 | Hoecker | 123/503 |
| 4,907,555 | 3/1990 | Fuchs | 123/446 |
| 4,907,559 | 3/1990 | Rathmayr | 123/446 |
| 5,056,469 | 10/1991 | Kimberley | 123/23 |
| 5,067,464 | 11/1991 | Rix et al. | 123/446 |
| 5,072,709 | 12/1991 | Long et al. | 123/446 |
| 5,074,766 | 12/1991 | Kochanowski | 417/496 |
| 5,097,812 | 3/1992 | Augustin | 123/500 |
| 5,168,847 | 12/1992 | Grieshaber et al. | 123/299 |
| 5,209,208 | 5/1993 | Siebert et al. | 123/503 |
| 5,211,549 | 5/1993 | Kraemer | 417/499 |
| 5,219,280 | 6/1993 | Yashiro | 417/499 |
| 5,224,846 | 7/1993 | Kirschner | 123/501 |
| 5,233,955 | 8/1993 | Kraemer et al. | 123/299 |
| 5,492,098 | 2/1996 | Hafner | 123/446 |
| 5,575,253 | 11/1996 | Lambert | 123/446 |

FOREIGN PATENT DOCUMENTS 2099078 12/1982 United Kingdom .

*Primary Examiner*—Carl S. Miller
*Attorney, Agent, or Firm*—Liell & McNeil

[57] ABSTRACT

A hydraulically-actuated fuel injector comprises an injector body that defines a nozzle chamber that opens to a nozzle outlet and a plunger bore, and a spill port that opens into the plunger bore. A hydraulic means within the injector body pressurizes fuel in the nozzle chamber, and includes a plunger with an end face, a side surface and a centerline. The plunger is positioned in the plunger bore and moveable a stroke distance between a retracted position and an advanced position. A needle valve member is positioned in the nozzle chamber and moveable between an open position in which the nozzle outlet is open and a closed position in which the nozzle outlet is blocked. The plunger includes a groove in its side surface that is arranged in a helical pattern about the centerline and further includes a spill passage extending between the end face and the groove. A pin and guide slot assembly, within the injector body, are provided for rotating the plunger about the centerline when the plunger is moving a portion of the stroke distance between its advanced position and its retracted position. Finally, the injector includes a control valve for stopping the plunger at a metered position between its retracted position and its advanced position when the plunger is retracting from its advanced position.

20 Claims, 3 Drawing Sheets

INJECTION RATE SHAPING DEVICE FOR A FILL METERED HYDRAULICALLY-ACTUATED FUEL INJECTION SYSTEM

TECHNICAL FIELD

The present invention relates generally to fill metered hydraulically-actuated fuel injectors, and more particularly to such injectors having a rate shaping spill device incorporated into the operation of the plunger and barrel assembly.

BACKGROUND ART

Fuel injection rate shaping is a process of tailoring the initial portion of fuel delivery to control the amount of fuel delivered during the ignition delay portion and the main injection portion of an injection cycle. This process modifies the heat release characteristics of the combustion process and is beneficial in reducing undesirable emissions and noise levels from the engine.

Caterpillar Inc.'s U.S. Pat. No. 5,492,098 on a Flexible injection Rate Shaping Device For A Hydraulically-Actuated Fuel Injection System describes an apparatus for variably controlling the fuel flow characteristics of a hydraulically-actuated fuel injector during an injection cycle. This injector generally accomplishes front end rate shaping by spilling fuel over a portion of the plunger's initial downward stroke during an injection event. The opening of the spill port causes a lowering of fuel pressure during the initial portion of the injection event so that less fuel leaves the nozzle outlet of the injector. Performance of the rate shaping aspects of the injector are primarily controlled by the geometry of the spill passage and the plunger movement rate during the initial portion of the injection event. While hydraulically-actuated fuel injectors of this type have performed magnificently for many years, the incorporation of this technology into fill metered hydraulically-actuated fuel injection systems is more problematic.

Generally, the incorporation of a rate shaping spill passage into the plunger and barrel assembly is desirable since the plunger begins its downward stroke from the same retracted position regardless the amount of fuel to be injected. However, when fill metering features are incorporated into a hydraulically-actuated fuel injector, the plunger begins its downward stroke from a different position depending upon the amount of fuel to be injected. In other words, between injection events, the plunger retracts only as far as is necessary to draw into the fuel pressurization chamber the precise amount of fuel to be injected in the next injection event. Consequently, a fixed initial geometry between the plunger and barrel is not readily possible, making the incorporation of a spill passage significantly more problematic in fill metered hydraulically-actuated fuel injectors.

The present invention is directed to overcoming one or more of the problems as set forth above.

DISCLOSURE OF THE INVENTION

A hydraulically-actuated fuel injector comprises an injector body that defines a nozzle chamber that opens to a nozzle outlet and a plunger bore, and a spill port that opens into the plunger bore. A hydraulic means within the injector body pressurizes fuel in the nozzle chamber, and includes a plunger with an end face, a side surface and a centerline. The plunger is positioned in the plunger bore and moveable a stroke distance between a retracted position and an advanced position. A needle valve member is positioned in the nozzle chamber and moveable between an open position in which the nozzle outlet is open and a closed position in which the nozzle outlet is blocked. The plunger includes a groove in its side surface that is arranged in a helical pattern about the centerline and further includes a spill passage extending between the end face and the groove. Means, within the injector body, are provided for rotating the plunger about the centerline when the plunger is moving a portion of the stroke distance between its advanced position and its retracted position. Finally, the injector includes means for stopping the plunger at a metered position between its retracted position and its advanced position when the plunger is retracting from its advanced position.

In another embodiment of the present invention, a hydraulically-actuated fuel injector includes an injector body having an actuation fluid cavity that opens to an actuation fluid inlet, an actuation fluid drain and a piston bore. The injector body also has a plunger bore that opens to a fuel supply passage and a nozzle chamber, and the nozzle chamber opens to a nozzle outlet. Finally, the injector body includes a spill port that opens into the plunger bore. A control valve is mounted in the injector body and is moveable between a first position that opens the actuation fluid inlet and closes the actuation fluid drain, and a second position that closes the actuation fluid inlet and opens the actuation fluid drain. A piston is positioned to reciprocate in the piston bore between an upper position and a lower position. A plunger having a side surface, an end face, and a centerline is positioned to reciprocate in the plunger bore a stroke distance between an advanced position and a retracted position. The plunger further includes a groove in its side surface arranged in a helical pattern about the centerline and a spill passage extending between its end face and the groove. A portion of the plunger bore and the plunger define a fuel pressurization chamber that opens to the nozzle chamber. A valve is positioned in the fuel supply passage and is operable to prevent a flow of fuel from the fuel pressurization chamber back into the fuel supply passage. A needle valve member is positioned to reciprocate in the nozzle chamber between a closed position that blocks the nozzle outlet and an open position that opens the nozzle outlet. Means, within the injector body, are provided for biasing the needle valve member toward its closed position. Also included are means for stopping the plunger at a metered position between its retracted position and its advanced position when the plunger is retracting from its advanced position. Finally, means are provided within the injector body for rotating the plunger about its centerline when the plunger is moving a portion of its stroke distance between the advanced position and the retracted position.

In still another embodiment of the present invention, a fuel injection system includes a source of high pressure actuation fluid, a low pressure actuation fluid reservoir and a source of fuel fluid different from the actuation fluid. A hydraulically-actuated fuel injector includes an injector body that defines a fuel supply passage, a nozzle chamber that opens to a nozzle outlet and a plunger bore, and a spill port that opens into the plunger bore. A hydraulic means within the injector body pressurizes fuel in the nozzle chamber, and includes a plunger with an end face, a side surface and a centerline. The plunger is positioned in the plunger bore and moveable a stroke distance between a retracted position and an advanced position. A needle valve member is positioned in the nozzle chamber and movable between an open position in which the nozzle outlet is open and a closed position in which the nozzle outlet is blocked.

The plunger includes a groove in its side surface arranged in a helical pattern about the centerline and further includes a spill passage extending between its end face and the groove. Means within the injector body rotates the plunger about the centerline when the plunger is moving a portion of its stroke distance between its advanced position and its retracted position. Means are provided for stopping the plunger at a metered position between its retracted position and its advanced position when the plunger is retracting from its advanced position. A first supply passage connects the actuation fluid inlet of the injector to the source of high pressure actuation fluid. A second supply passage connects the fuel supply passage to the source of fuel fluid that is different from the actuation fluid. A drain passage connects the actuation fluid drain to the low pressure actuation fluid reservoir. A control valve is positioned in the actuation fluid cavity of the injector and is capable of moving between a first position in which the actuation fluid inlet is open and the actuation fluid drain is closed, and a second position in which the actuation fluid inlet is closed and the actuation fluid drain is open. Finally, a computer is in communication with and capable of controlling the control valve.

One object of the present invention is to introduce front end rate shaping into a fill metered hydraulically-actuated fuel injection system.

Another object of the present invention is to incorporate proven fuel spillage concepts into the plunger and barrel assembly of a fill metered hydraulically-actuated fuel injector.

Still another object of the present invention is to provide an improved fill metered hydraulically-actuated fuel injection system.

BEST MODE FOR CARRYING OUT THE INVENTION

Figure 1:
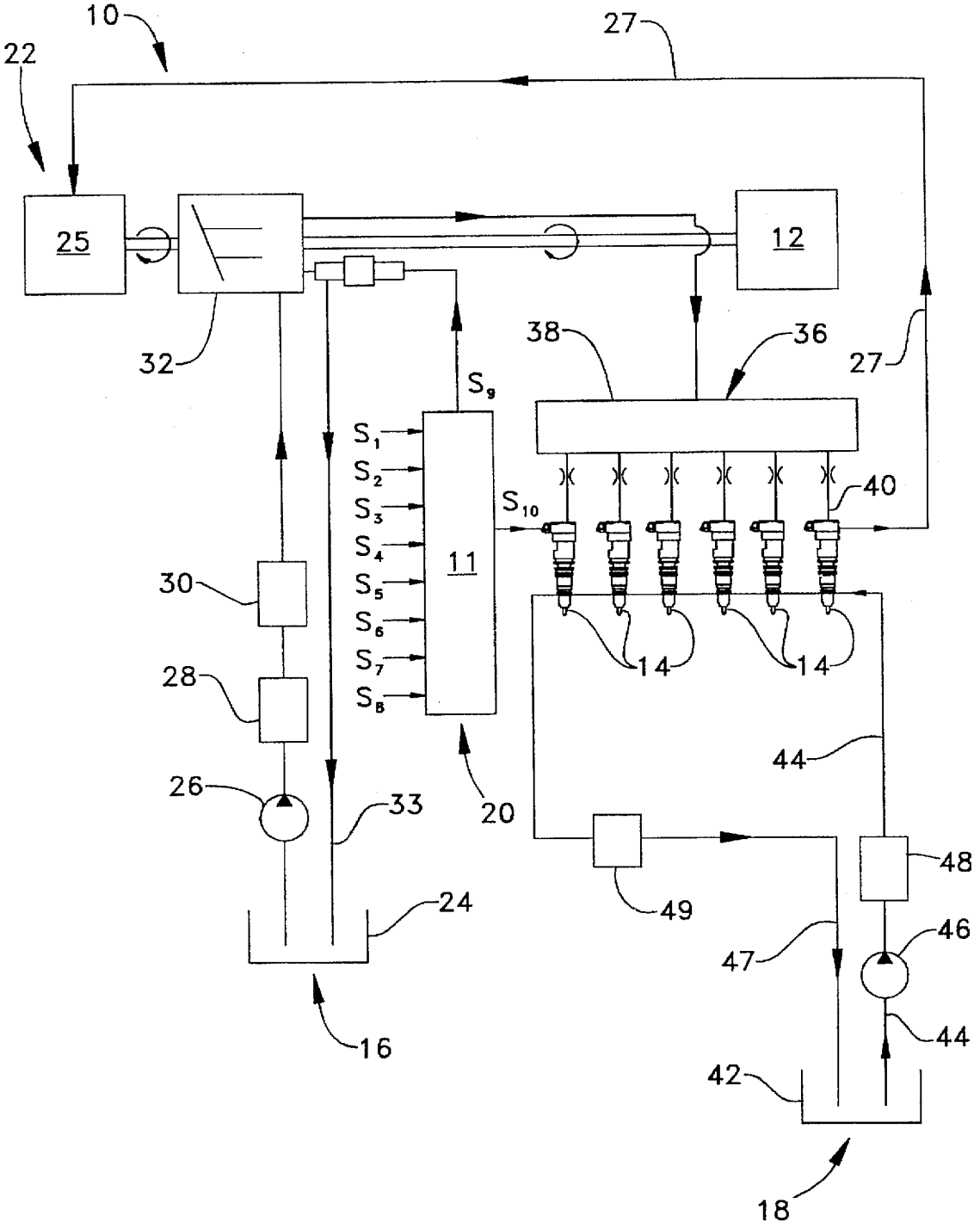
FIG. 1 is a schematic illustration of a hydraulically actuated electronically controlled fuel injection system according to the present invention.

Referring now to FIG. 1, there is shown an embodiment of a hydraulically-actuated electronically controlled fuel injection system 10 in an example configuration as adapted for a direct injection diesel cycle internal combustion engine 12. Fuel system 10 includes one or more hydraulically-actuated electronically controlled fuel injectors 14, which are adapted to be positioned in a respective cylinder head bore of engine 12. Fuel system 10 includes an apparatus or means 16 for supplying actuating fluid to each injector 14, an apparatus or means 18 for supplying fuel to each injector, a computer 20 for electronically controlling the fuel injection system, and an apparatus or means 22 for recirculating actuation fluid and for recovering hydraulic energy from the actuation fluid leaving each of the injectors.

The actuating fluid supply means 16 preferably includes an actuating fluid sump 24, a relatively low pressure actuating fluid transfer pump 26, an actuating fluid cooler 28, one or more actuation fluid filters 30, a high pressure pump 32 for generating relatively high pressure in the actuation fluid and at least one relatively high pressure actuation fluid manifold 36. A common rail passage 38 is arranged in fluid communication with the outlet from the relatively high pressure actuation fluid pump 32. A rail branch passage 40 connects the actuation fluid inlet 50 (FIG. 2) of each injector 14 to the high pressure common rail passage 38.

Actuation fluid leaving the actuation fluid drain 51 (see FIG. 2) of each injector 14 enters a recirculation line 27 that carries the same to the hydraulic energy recirculating or recovering means 22. A portion of the recirculated actuation fluid is channeled to high pressure actuation fluid pump 32 and another portion is returned to actuation fluid sump 24 via a recirculation line 33.

Any available engine fluid is preferably used as the actuation fluid in the present invention. However, in the preferred embodiments, the actuation fluid is engine lubricating oil and the actuation fluid sump 24 is an engine lubricating oil sump. This allows the fuel injection system to be connected directly into the engine's lubricating oil circulation system. Alternatively, the actuation fluid could be provided by a fuel tank 42 or another source, such as coolant fluid, etc.

The fuel supply means 18 preferably includes a fuel tank 42, a fuel supply passage 44 arranged in fluid communication between fuel tank 42 and the fuel inlet 77 (FIG. 2) of each injector 14, a relatively low pressure fuel transfer pump 46, one or more fuel filters 48, a fuel supply regulating valve 49, and a fuel circulation and return passage 47 arranged in fluid communication between injectors 14 and fuel tank 42.

The computer 20 preferably includes an electronic control module 11 which controls (1) the fuel injection timing; (2) the total fuel injection quantity during an injection cycle; (3) the fuel injection pressure; (4) the number of separate injections or injection segments during each injection cycle; (5) the time intervals between the injection segments; (6) the fuel quantity of each injection segment during an injection cycle; (7) the actuation fluid pressure; and (8) any combination of the above parameters. Computer 20 receives a plurality of sensor input signals $S_1$–$S_8$, which correspond to known sensor inputs, such as engine operating condition, load, etc., that are used to determine the precise combination of injection parameters for a subsequent injection cycle. In this example, computer 20 issues a control signal $S_9$ to control the actuation fluid pressure and a control signal $S_{10}$ to control the actuation fluid control valve within each injector 14. Each of the injection parameters are variably controllable independent of engine speed and load. In the case of injector 14, control signal $S_{10}$ represents current to the solenoid 57 (FIG. 2) commanded by computer 20.

Figure 2:
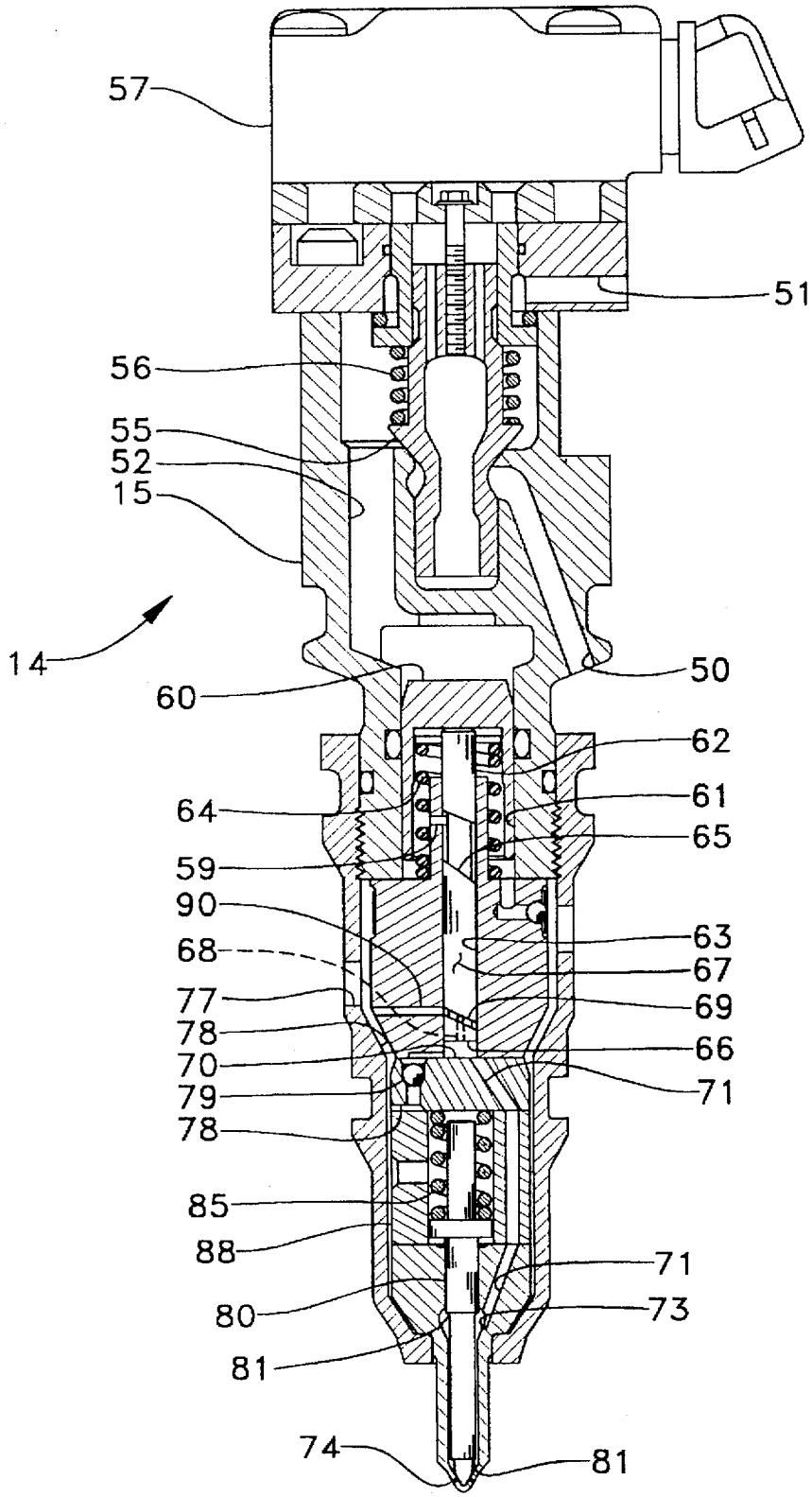
FIG. 2 is a sectioned side elevational view of a hydraulically-actuated electronically controlled fuel injector according to the present invention.

Referring now to FIG. 2, hydraulically-actuated fuel injector 14 includes an injector body 15 made up of various components attached to one another in a manner well known in the art. Injector body 15 defines an actuation fluid cavity 52 that is open to a piston bore 61, a high pressure actuation fluid inlet 50 and a low pressure actuation fluid drain 51. A control valve is mounted in the injector body and includes a poppet valve member 55 that is attached to and moved by a solenoid 57. A compression spring 56 normally biases poppet valve member 55 to its lower seated position which closes actuation fluid cavity 52 to actuation fluid inlet 50. When in this position, actuation fluid cavity 52 is opened to low pressure actuation fluid drain 51. When solenoid 57 is energized, poppet valve member 55 is lifted from its lower seated position to an upper seated position which simultaneously closes low pressure actuation fluid drain 51 and opens actuation fluid inlet 50 to actuation fluid cavity 52. Each injection event is initialized by energizing solenoid 57 to permit high pressure actuation fluid to flow into actuation fluid cavity 52 to act on the upper surface of an intensifier piston 60.

Intensifier piston 60 is positioned to reciprocate in piston bore 61 between an upper position and a lower position, as shown. Injector body 15 also defines a plunger bore 63 that slidably receives a plunger 62. Plunger 62 reciprocates between a retracted position and an advanced position, as shown. A compression return spring 64 normally biases piston 60 and plunger 62 to their respective upper and retracted positions. Plunger 62 includes an end face 66, a side surface 67 and a centerline. A helical groove 69 is machined in the side surface 67, and a pressure relief passage 68 extends between end face 66 and groove 69. A guide slot 65 is also machined in the side surface 67 of plunger 62. A portion of plunger bore 63 and plunger 62 define a fuel pressurization chamber 70.

Fuel enters injector 14 through a fuel inlet 77 and then travels along a fuel supply passage 78, past ball check 79 and into fuel pressurization chamber 70, when plunger 62 and piston 60 are undergoing their return stroke between injection events. Ball check valve 79 prevents the back flow of fuel from fuel pressurization chamber 70 into fuel supply passage 78 when plunger 62 and piston 60 are undergoing their downward stroke during an injection event.

Injector body 15 also defines a nozzle chamber 73 that opens to a nozzle outlet 74. Nozzle chamber 73 is connected to fuel pressurization chamber 70 via a nozzle supply passage 71. During an injection event, fuel flows from fuel pressurization chamber 70, through nozzle supply passage 71, into nozzle chamber 73 and eventually out of nozzle outlet 74. A needle valve member 80 is positioned to reciprocate in nozzle chamber 73 between an open position in which nozzle outlet 74 is open and a closed position, as shown, in which nozzle outlet 74 is blocked. A biasing spring 85 normally biases needle valve member 80 to its closed position. However, when fuel pressure within nozzle chamber 73 exceeds a valve opening pressure, the hydraulic force acting on lifting surface(s) 81 causes the needle valve member to lift against the action of biasing spring 85 to its open position.

Injector 14 is a fill metered type of injector, in which the plunger 62 retracts between injection events only so far as is necessary to draw in a precise amount of fuel into fuel pressurization chamber 70 for a subsequent injection event. As a consequence, plunger 62 stops at a metered position between its advanced and retracted positions which can and often is different for each injection event. For example, at idle conditions, the plunger 62 only retracts a short distance corresponding to a relatively small amount of fuel; however, at rated conditions the plunger might retract to its fully retracted position in order to inject the maximum amount of fuel. Since the geometry of plunger 62 relative to plunger bore 63 is different for each amount of fuel to be injected, the present invention contemplates rotating the plunger in order to reset helical groove 69 a fixed lead distance above spill port 90 for each injection event. This rotation is produced by mounting a pin 59 in injector body 15 to project into plunger bore 63. The exposed end of pin 59 is received in a guide slot 65 machined into the side surface 67 of plunger 62.

Figure 3:
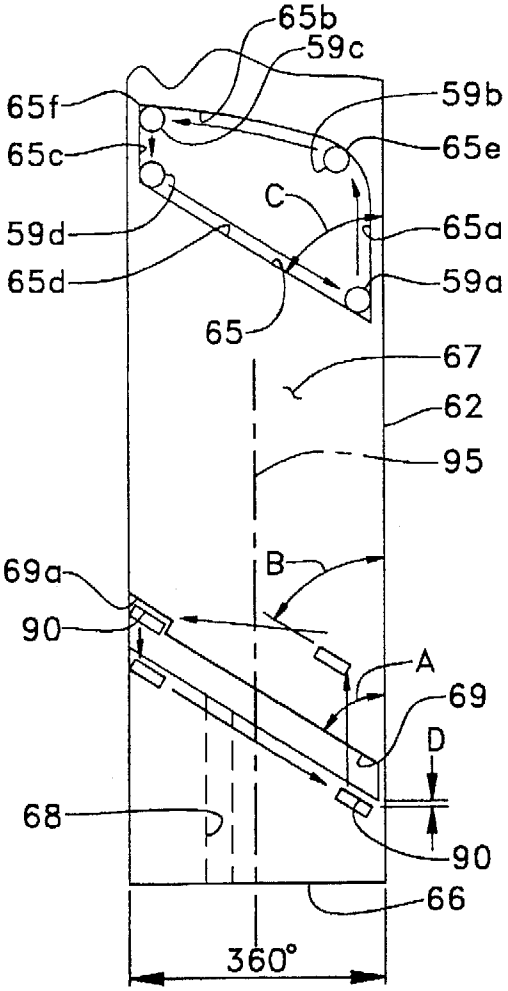
FIG. 3 is an unrolled partial side elevational view of the plunger showing the relative positioning of the spill port and guide pin during an injection cycle for a maximum amount of fuel.

Referring now to FIG. 3, plunger 62 is shown unrolled so that the complete 360M circumference of its side surface 67 can be seen. Helical groove 69 is machined into side surface 67 at a helix angle A with respect to centerline 95. Groove 69 preferably extends less than 360M around centerline 95 of plunger 62. Groove 69 also preferably includes a notched portion **69*a*** which serves as a portion of a pressure relief passage, to release pressure and provide an abrupt end to each injection event.

FIG. 3 is also useful in illustrating how plunger 62 is made to rotate. A guide slot 65 having a generally quadrilateral shape is machined into side surface 67 of plunger 62. Guide slot 65 includes a first vertical side **65*a* connected to a helically oriented side 65*b* through a rounded corner 65*e*. A second vertical side 65*c* is connected to helically oriented side 65*b* at a relatively sharp corner 65*f*. Finally, a second helically oriented side 65*d*, which is at a different angle with respect to centerline 95 than the first helically oriented side 65*b*, is connected at each end to the vertically oriented sides 65*a* and 65*c*, respectively. It being understood that centerline 95 is vertically oriented so that side 65*a* and 65*c* are parallel to the centerline. Because of this parallel relationship, guide slot 65** can be thought of as having a generally trapezoidal shape with at least one rounded corner.

Apart from illustrating the preferred shapes of helical groove 69 and guide slot 65, FIG. 3 is useful in illustrating the relative positioning of spill port 90 and pin 59 as the plunger is undergoing a complete injection cycle. Recalling that pin 59 and spill port 90 have fixed positions within injector body 15 and fixed relative locations to one another. At the beginning of the injection event shown in FIG. 3, spill port 90 is at a fixed lead distance D below helical groove 69, and pin **59*a* is positioned in the lower right-hand corner of guide slot 65. It is important to note that spill port 90 is rectangular in shape and is itself oriented at a spill angle B which is substantially equal to the helix angle A of helical groove 69. Lead distance D is chosen in order to allow fuel pressure to build and a pilot injection to occur before spill port 90 opens to helically oriented groove 69. Spill port 90 and helical groove 69 are preferably sized such that when the two are open to one another, fuel pressure within nozzle chamber 73 drops sufficiently low that needle valve member 80** briefly closes in order to provide a split injection in each injection event. As an alternative, the two could be sized such that fuel is spilled but fuel pressure remains sufficiently high to hold needle valve member open so that the injection rate is merely reduced rather than temporarily stopped.

As the injection event begins, plunger 62 moves downward, spill port 90 briefly opens to helical groove 69 and then pin **59*b* comes into contact with rounded corner 65*e* of guide slot 65. This begins the first rotation of plunger 62. However, injection continues until pin 59*c* reaches corner 65*f* of guide slot 65. At this point, the notch 69*a* and helical groove 69 again opens spill port 90 so that pressure underneath the plunger is relieved and needle valve member 80 quickly closes to provide an abrupt end to injection. Thus, pressure relief passage 68, helical groove 69 and notch 69*a* function as a pressure relief passage to provide an abrupt end to injection. Furthermore, spill port 90 doubles as a fuel return passage for the release of pressure to again provide an abrupt end to each injection event. After a predetermined delay period, plunger 62 begins retracting and then pin 59*d* encounters edge 65*d* of guide slot 65**, causing the plunger to again rotate.

Figure 4:
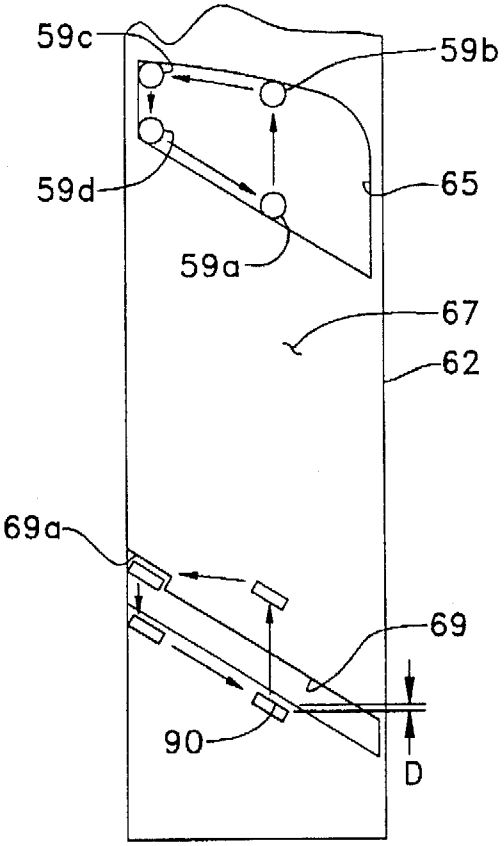
FIG. 4 is an unrolled partial side elevational view of the plunger showing the relative positioning of the spill port and guide pin during an injection cycle for a medium amount of fuel.

Depending upon the amount of fuel to be injected in a subsequent injection event, plunger 62 is stopped at a metered position which is somewhere between its fully retracted and fully advanced positions. For instance, if a medium amount of fuel is to be injected in the next injection event, plunger 62 would retract only so far as is shown in FIG. 4. Nevertheless, the precise geometry between the various features again positions spill port 90 a fixed lead distance D below helical groove 69 regardless the amount of fuel to be injected in a subsequent injection event. This feature results in the front end portion of each injection event being substantially identical. However, those skilled in the art will appreciate that by slightly varying helix angle A relative to spill angle B, different lead distances D could be incorporated into the injector, such that a different lead distance would exist depending upon the amount of fuel to be injected.

Figure 5:
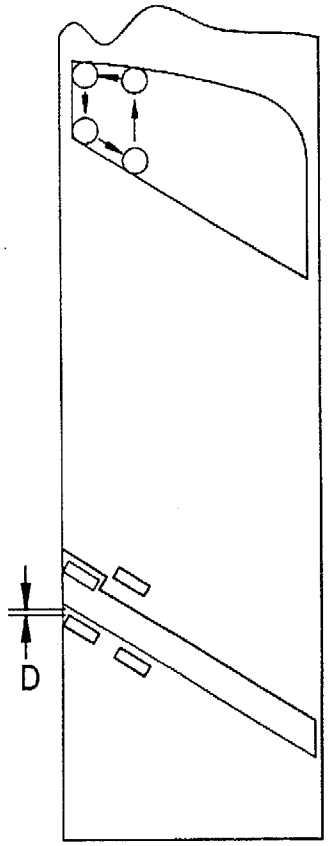
FIG. 5 is an unrolled partial side elevational view of the plunger showing the relative positioning of the spill port and guide pin during an injection cycle for an idle amount of fuel.

FIG. 5 shows the relative positioning of the various features during an idle injection event.

INDUSTRIAL APPLICABILITY

Each injection event is initiated by computer 20 commanding solenoid 57 to be energized in order to open actuation fluid inlet 50 to actuation fluid cavity 52. When this occurs, high pressure actuation fluid begins to flow into actuation fluid cavity 52 acting on the top surface of intensifier piston 60, starting it to move downward. This in turn causes plunger 62 to begin its downward stroke. Fuel pressure within fuel pressurization chamber 70 begins to rise and eventually reaches a valve opening pressure sufficient to overcome needle return spring 85. As needle valve member 80 begins to lift, fuel begins to exit nozzle outlet 74. As plunger 62 continues its downward stroke, helical groove 69 opens to spill port 90 allowing fuel to spill. This preferably lowers pressure in nozzle chamber sufficiently that the needle valve member 80 briefly closes. Eventually, plunger 62 reaches a position in which notch 69*a* of groove 69 reopens to spill port 90, which extends between plunger bore 63 and fuel inlet 77. When this occurs, the fuel pressure in fuel pressurization chamber 70 and nozzle chamber 73 is quickly released through pressure relief passage 68, causing needle valve member 80 to return to its closed position under the action of biasing spring 85. This ends the injection event. It should be noted, however, that the solenoid 57 continues to be energized so that actuation fluid inlet 50 continues to be open, causing piston 60 and plunger 62 to continue their downward movement until they reach the end of their stroke.

The solenoid 57 remains energized holding piston 60 and plunger 62 in their respective lower and advanced positions until the refilling mode begins. The computer then determines the amount of time necessary to allow a desired amount of fuel to enter injector 14 before it is time to initialize the next injection event. The refilling mode is commenced by de-energizing solenoid 57 so that actuation fluid cavity 52 is once again open to low pressure actuation fluid drain 51. This allows return spring 64 to begin retracting plunger 62 and piston 60. Fuel is then drawn into fuel inlet 77, through fuel supply passage 78 and past ball valve member 79 into fuel pressurization chamber 70. When the precise amount of fuel has been metered into the injector and the time for the next injection event has come, solenoid 57 is again energized to open high pressure actuation fluid inlet 50. This causes plunger 62 and piston 60 to briefly stop at a metered position somewhere between their respective advanced and retracted positions. The flow of high pressure actuation fluid 50 again flows into actuation fluid cavity 50 to initiate the next injection event.

Those skilled in the art will appreciate that by properly sizing and positioning spill port 90, pin 59 positioning spill port 90, pin 59, helical grove 69, notch 69*a* and guide slot 65, virtually any front end rate shaping profile can be achieved. For example, front end split injection can be accomplished, or a boot shaped front end injection profile can be achieved. Also, the lead distance D can be varied for different amounts of fuel by forming helix angle A different to that of guide angle C. Angles A and C are shown equal in the preferred embodiment. Another alternative might be to make helix angle A vary around the circumference of the plunger so that lead distance D has a nonlinear relationship to the amount of fuel to be injected. Finally, by positioning the various features in the way shown in FIGS. 3, 4 and 5, spill port 90 and helical groove 69 can double as a means for producing front end rate shaping and as a means for releasing fuel pressure toward the end of the plunger stroke to provide an abrupt end to each injection event. Those skilled in the art will appreciate that other helical groove shapes and guide slot shapes could be introduced to provide specific desirable injector performance characteristics. Other objects and advantages of the present invention will become apparent from a review of the attached drawings, the claims and the above specification.

I claim:

1. A hydraulically actuated fuel injector comprising:

an injector body that defines a nozzle chamber that opens to a nozzle outlet and a plunger bore, and a spill port that opens into said plunger bore;

hydraulic means within said injector body for pressurizing fuel in said nozzle chamber that includes a plunger with an end face, a side surface and a centerline, and said plunger being positioned in said plunger bore and moveable a stroke distance between a retracted position and an advanced position;

a needle valve member positioned in said nozzle chamber and moveable between an open position in which said nozzle outlet is open and a closed position in which said nozzle outlet is blocked;

said plunger including a groove in said side surface arranged in a helical pattern about said centerline and further including a spill passage extending between said end face and said groove;

means, within said injector body, for rotating said plunger about said centerline when said plunger is moving a portion of said stroke distance between said advanced position and said retracted position; and means for stopping said plunger at a metered position between said retracted position and said advanced position when said plunger is retracting from said advanced position.

2. The hydraulically actuated fuel injector of claim 1 wherein said means for rotating rotates said plunger into a position in which said groove is a substantially fixed lead distance above said spill port when said plunger is at said metered position.

3. The hydraulically actuated fuel injector of claim 2 wherein said spill port has a rectangular cross section that is oriented at a spill angle less than 90M with respect to said centerline.

4. The hydraulically actuated fuel injector of claim 3 wherein said groove is oriented at a helix angle with respect to said centerline that is about equal to said spill angle.

5. The hydraulically actuated fuel injector of claim 2 wherein said groove extends less than 360M around said plunger about said centerline.

6. The hydraulically actuated fuel injector of claim 1 wherein said means for rotating includes a pin mounted in one of said plunger or said injector body that projects into a guide slot defined by the other of said plunger or said injector body.

7. The hydraulically actuated fuel injector of claim 6 wherein said pin is mounted in said injector body to project into said plunger bore; and said guide slot is machined in said side surface of said plunger.

8. The hydraulically actuated fuel injector of claim 7 wherein said guide slot has a generally quadrilateral shape with at least one rounded corner.

9. The hydraulically actuated fuel injector of claim 8 wherein said generally quadrilateral shape is a trapezoidal shape.

10. The hydraulically actuated fuel injector of claim 9 wherein a portion of two different sides of said trapezoidal shape are parallel to said centerline.

11. The hydraulically actuated fuel injector of claim 10 wherein a portion of two other different sides of said trapezoidal shape are helically oriented with respect to said centerline at angles different from one another.

12. The hydraulically actuated fuel injector of claim 1 wherein said injector body includes a fuel return passage that opens into said plunger bore;

said plunger includes a pressure relief passage that opens on one end through said end face and opens on its other end through said side surface;

a portion of said plunger bore and said plunger define a fuel pressurization chamber; and said pressure relief passage opens said fuel pressurization chamber to said fuel return passage when said plunger approaches said advanced position.

13. The hydraulically actuated fuel injector of claim 1 wherein said injector body includes an actuation fluid cavity that opens to an actuation fluid inlet, an actuation fluid drain and a piston bore; and a control valve mounted in said injector body and being moveable between a first position that opens said actuation fluid inlet and closes said actuation fluid drain, and a second position that closes said actuation fluid inlet and opens said actuation fluid drain.

14. The hydraulically actuated fuel injector of claim 13 wherein said means for stopping includes a solenoid attached to said control valve and capable of moving said control valve from said second position to said first position.

15. A hydraulically actuated fuel injector comprising:

an injector body having an actuation fluid cavity that opens to an actuation fluid inlet, an actuation fluid drain and a piston bore, and having a plunger bore that opens to a fuel supply passage and a nozzle chamber, and said nozzle chamber opens to a nozzle outlet, and further having a spill port that opens into said plunger bore;

a control valve mounted in said injector body and being movable between a first position that opens said actuation fluid inlet and closes said actuation fluid drain, and a second position that closes said actuation fluid inlet and opens said actuation fluid drain;

a piston positioned to reciprocate in said piston bore between an upper position and a lower position;

a plunger having a side surface, an end face and a centerline, and being positioned to reciprocate in said plunger bore a stroke distance between an advanced position and a retracted position, and said plunger further including a groove in said side surface arranged in a helical pattern about said centerline and a spill passage extending between said end face and said groove;

a portion of said plunger bore and said plunger defining a fuel pressurization chamber that opens to said nozzle chamber;

a valve positioned in said fuel supply passage and being operable to prevent flow of fuel from said fuel pressurization chamber back into said fuel supply passage;

a needle valve member positioned to reciprocate in said nozzle chamber between a closed position that blocks said nozzle outlet and an open position that opens said nozzle outlet;

means, within said injector body, for biasing said needle valve member toward said closed position;

means for stopping said plunger at a metered position between said retracted position and said advanced position when said plunger is retracting from said advanced position; and means, within said injector body, for rotating said plunger about said centerline when said plunger is moving a portion of said stroke distance between said advanced position and said retracted position.

16. The hydraulically actuated fuel injector of claim 15 wherein said means for rotating rotates said plunger into a position in which said groove is a substantially fixed lead distance above said spill port when said plunger is at said metered position.

17. The hydraulically actuated fuel injector of claim 16 wherein said means for rotating includes a pin mounted in said injector body that projects into said plunger bore, and a guide slot machined in said side surface of said plunger.

18. A fuel injection system comprising:

a source of high pressure actuation fluid;

a low pressure actuation fluid reservoir;

a source of fuel fluid different from said actuation fluid;

a hydraulically actuated fuel injector comprising: an injector body that defines a fuel supply passage, a nozzle chamber that opens to a nozzle outlet and a plunger bore, and a spill port that opens into said plunger bore;

hydraulic means within said injector body for pressurizing fuel in said nozzle chamber that includes a plunger with an end face, a side surface and a centerline, and said plunger being positioned in said plunger bore and moveable a stroke distance between a retracted position and an advanced position;

a needle valve member positioned in said nozzle chamber and moveable between an open position in which said nozzle outlet is open and a closed position in which said nozzle outlet is blocked;

said plunger including a groove in said side surface arranged in a helical pattern about said centerline and further including a spill passage extending between said end face and said groove;

means, within said injector body, for rotating said plunger about said centerline when said plunger is moving a portion of said stroke distance between said advanced position and said retracted position; and the system further comprising:

means for stopping said plunger at a metered position between said retracted position and said advanced position when said plunger is retracting from said advanced position;

a first supply passage connecting said actuation fluid inlet to said source of high pressure actuation fluid;

a second supply passage connecting said fuel supply passage to said source of fuel fluid different from said actuation fluid;

a drain passage connecting said actuation fluid drain to said low pressure actuation fluid reservoir;

a control valve positioned in said actuation fluid cavity and capable of moving between a first position in which said actuation fluid inlet is open and said actuation fluid drain is closed, and a second position in which said actuation fluid inlet is closed and said actuation fluid drain is open; and a computer in communication with and capable of controlling said control valve.

19. The hydraulically actuated fuel injection system of claim 18 wherein said means for rotating rotates said plunger into a position in which said groove is a substantially fixed lead distance above said spill port when said plunger is at said metered position.

20. The hydraulically actuated fuel injection system of claim 19 wherein said means for rotating includes a pin mounted in said injector body that projects into said plunger bore, and a guide slot machined in said side surface of said plunger.

* * * * *